US005830298A

United States Patent [19]

Jackson

[11] Patent Number: 5,830,298

[45] Date of Patent: Nov. 3, 1998

[54] LOOP FASTENING MATERIAL

[75] Inventor: Byron M. Jackson, Stacy, Minn.

[73] Assignee: Minnesota Mining and Manufacturing Co., St. Paul, Minn.

[21] Appl. No.: 906,590

[22] Filed: Aug. 5, 1997

Related U.S. Application Data

[62] Division of Ser. No. 706,007, Aug. 30, 1996, Pat. No. 5,699,593.

[51] Int. Cl.[6] ..... A44B 18/00; A61F 13/15; D04H 3/00; D06C 3/00

[52] U.S. Cl. ..... 156/66; 24/445; 24/452; 24/448; 156/72; 156/178; 156/229; 156/290; 156/244.24; 156/244.25

[58] Field of Search ..... 24/306, 442–457, 24/575–577; 156/66, 72, 178, 183, 229, 244.1, 244.22, 244.24, 244.25, 290

[56] References Cited

U.S. PATENT DOCUMENTS

| | | | |
|---|---|---|---|
| 3,382,122 | 5/1968 | Nalle, Jr. | 156/167 |
| 3,577,607 | 5/1971 | Ikoma et al. | 24/204 |
| 3,694,867 | 10/1972 | Stumpf | 24/204 |
| 3,773,580 | 11/1973 | Provost | 156/66 |
| 3,849,840 | 11/1974 | Yamada et al. | 24/204 |
| 3,913,183 | 10/1975 | Brumlik | 24/204 |
| 3,940,525 | 2/1976 | Ballard | 428/96 |
| 4,223,059 | 9/1980 | Schwarz | 428/198 |
| 5,032,122 | 7/1991 | Noel et al. | 604/391 |
| 5,256,231 | 10/1993 | Gorman et al. | 156/178 |
| 5,307,616 | 5/1994 | Goineau et al. | 57/284 |
| 5,326,612 | 7/1994 | Goulait | 428/100 |
| 5,379,501 | 1/1995 | Goineau | 28/281 |
| 5,417,902 | 5/1995 | Bennie et al. | 264/103 |
| 5,447,590 | 9/1995 | Gilpatrick | 156/178 |
| 5,459,991 | 10/1995 | Nabeshima et al. | 57/287 |
| 5,470,417 | 11/1995 | Goulait | 156/201 |
| 5,595,567 | 1/1997 | King et al. | 24/448 X |
| 5,616,394 | 4/1997 | Gorman et al. | 24/448 X |
| 5,647,864 | 7/1997 | Allen et al. | 24/448 X |

FOREIGN PATENT DOCUMENTS

| | | |
|---|---|---|
| 0 223 075 A1 | 5/1987 | European Pat. Off. . |
| 0 258 015 A2 | 3/1988 | European Pat. Off. . |
| 0 289 198 A1 | 11/1988 | European Pat. Off. . |
| 0 325 473 A1 | 7/1989 | European Pat. Off. . |
| 0 330 415 A2 | 8/1989 | European Pat. Off. . |
| 0 341 993 B1 | 11/1989 | European Pat. Off. . |
| WO 95/33390 | 12/1995 | WIPO . |

*Primary Examiner*—James R. Brittain
*Assistant Examiner*—Robert J. Sandy
*Attorney, Agent, or Firm*—Gary L. Griswold; Robert W. Sprague; William J. Bond

[57] ABSTRACT

There is provided a loop fastening material for engaging a suitable male mechanical fastening element for a backing substrate of an oriented sheet material having a first face and a second face and substantially continuously attached to at least the first face a plurality of discrete, multi-filament transversely expanded yarns, such yarn filaments providing open loop structures. The yarns are expanded by transverse orientation of the backing to which it has been previously attached by extrusion bonding, adhesive bonding or the like. The resulting loop fastener provides a low cost, readily manufactured loop having good fastening properties to hook materials.

27 Claims, 5 Drawing Sheets

LOOP FASTENING MATERIAL

This is a division of application Ser. No. 08/706,007 filed Aug. 30, 1996. U.S. Pat. No. 5,699,593.

FIELD OF THE INVENTION

The present invention relates to a low-cost loop fastening material for hook and loop type mechanical fasteners and a method for producing the loop fastening material. This loop fastening material is especially useful for refastenable mechanical closures on disposable articles such as diapers, garments, feminine hygiene articles and adult incontinence pads.

BACKGROUND OF THE INVENTION

Hook and loop type mechanical fasteners are well known. Typically the loop portion of the mechanical fastener comprises a fabric-like backing having a multiplicity of upstanding loops projecting from its surface. These upstanding loops engage with the hooks on the hook portion of the mechanical fastener. Such loop materials are conventionally made by weaving or knitting yarn or fibrous loops in a woven base fabric, or by stitching loops into a fabric or film backing. While these conventional loop materials work well with many hook fastener materials, they are usually relatively expensive due to high manufacturing costs of the knitting, weaving or stitching processes used to produce the loop materials, which processes are relatively slow. The high cost and slow production rates for forming of the loop materials are particularly undesirable when the loops are intended to be used for only a limited time such as in a disposable article, for example, for refastenably attaching a disposable diaper to an infant or in a disposable packaging closure.

While several types of low-cost loop fastening materials have been proposed in the patent literature active investigation and development work continue with respect to providing suitable low cost loop fastening materials for disposable articles.

U.S. Pat. No. 5,032,122 discloses a loop fastening material having a backing of "orientable" material and a multiplicity of fibrous loop elements extending from the backing. The loop elements are formed by positioning continuous filaments on a backing of an "orientable" material and intermittently securing the filaments to the backing at spaced, fixed regions when the orientable material is in a dimensionally unstable state (i.e., when oriented). The filaments are preferably positioned on the backing parallel to each other and essentially parallel to the path of response of the orientable material. When the orientable material is caused to be transformed to its dimensionally stable state (e.g., by heat for a heat shrinkable material or release of tension for an elastic material), such that it gathers or contracts along its path of response, the loop elements are then formed by the shirring of the filaments between the fixed regions.

U.S. Pat. No. 5,256,231 and European Patent No. 341,993 B disclose a loop fastening material that includes a thermoplastic backing layer and a sheet of fibers having anchor portions bonded to the thermoplastic backing layer at spaced bonding locations and arcuate portions projecting from the front surface of the backing between adjacent spaced bonding locations. The sheet of loop material is made by passing a sheet of fibers between two corrugating rolls to form the anchor portions and the arcuate portions and then extruding the thermoplastic material onto the anchor portions.

Alternatively, a pre-formed backing of thermoplastic material can be bonded to the anchor portions of the sheet of fibers via thermal, sonic or adhesive bonding. The sheet of fibers can be a nonwoven or woven web. Alternatively, the fibers may be provided in the form of yarns which have been generally uniformly distributed to provide a sheet of fibers by passing them through a comb prior to feeding the fibers into the corrugating rolls.

U.S. Pat. No. 5,326,612 describes a loop fastening component that comprises a nonwoven web intermittently bonded to a film backing. The nonwoven web material has an outwardly facing surface that is relatively level, planar or flat in comparison to conventional loop fastening materials. The individual fibers of the nonwoven web serve to entangle or engage the hooks of the mating hook component of the hook and loop fastener. The nonwoven web has a relatively low basis weight of between about 6 and 42 grams/meter$^2$. The nonwoven web may comprise, among other types of nonwovens, a carded web or a spunbond web. The total area occupied by any bonds between only the fibers of the nonwoven web is preferably less than about six percent of the total area of the web. The nonwoven web is then preferably autogenously bonded to the backing. Types of bonding may include, but are not limited to, ultrasonic bonding and heat/pressure bonding. Typically the backing is a film, but it can also be a nonwoven or woven fabric. The total area occupied by both the bonds between the fibers comprising the nonwoven web and the autogenous bonds between the nonwoven web and the backing is between about ten and about thirty-five percent of the total area of the loop fastening material. The nonwoven web is not gathered between the autogenous bonds.

U.S. Pat. No. 5,447,590 proposes a method for producing a loop fastening material using continuous yarns, each yarn having a plurality of loops projecting outwardly and upwardly. The yarns are then formed into sheets of parallel yarns with a fixed spatial relationship by adhesive bonding to each other or a paper backing. The adhesively bonded loop fabric is then wound up in roll form. The yarns are treated to cause the loops to be combed upwardly by running the yarns through a reed mounted so that the output side of the reed forms an obtuse angle with the yarn exiting from the reed. The loops are formed in the yarns by overfeeding an effect fiber while forming a core and effect fiber.

U.S. Pat. No. 5,470,417 discloses a loop fastening material comprising at least two, preferably three, zones or layers. The first zone, referred to as the entanglement zone, accepts and engages the hooks of the mating hook component. The entanglement zone may be a woven fabric or a nonwoven web or any material that provides open space for hooks to penetrate and entangles the hooks until the fastener is opened. The second zone, referred to as the spacing zone, provides space for the hooks to occupy after penetrating the entanglement zone. The spacing zone again can comprise nonwoven webs or any other type of material that is capable of providing space for the hooks to occupy. The third zone is a backing that is adjacent to the spacing zone and provides a foundation for the spacing and entanglement zones. The backing could be a film and preferably the hooks of the mating hook component will not penetrate the backing. The individual zones or layers of the loop fastening material can be bonded together by a number of methods including stitching, ultrasonic bonding, adhesive bonding and heat/pressure bonds. The loop fastening material has an outwardly facing surface that is relatively flat in comparison to conventional loop fastening materials.

While several types of alternative low-cost loop fastening materials have been proposed in the patent literature, there is still a need for low-cost loop fastening materials for disposable articles.

SUMMARY OF THE INVENTION

Figure 1:
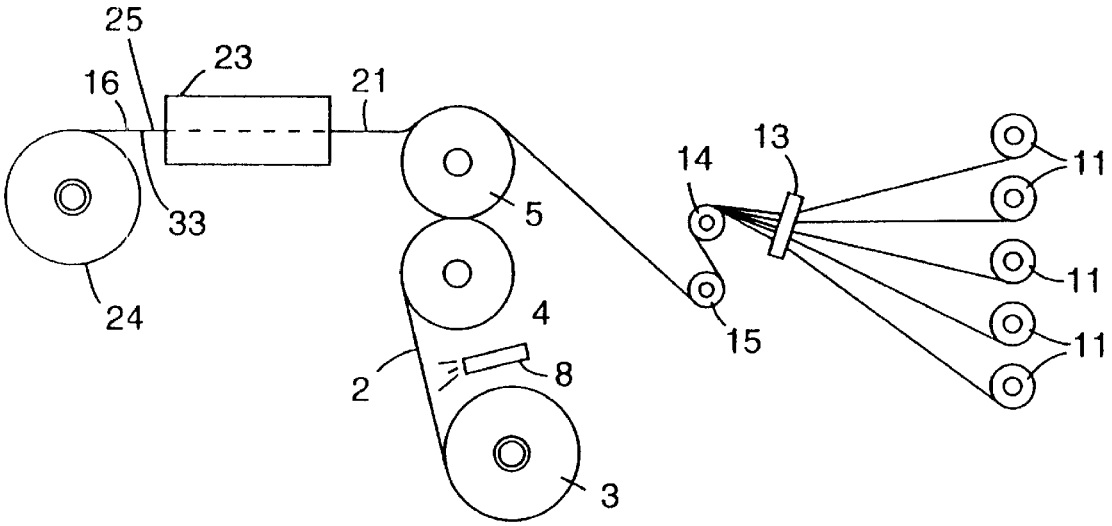
FIG. 1 is schematic representation of a method of making the invention fabric as shown in FIGS. 4 and 6.

The present invention provides a female or loop fastening material for use as a fastening component in a hook and loop fastening device. The loop fastening material of the invention is designed to engage male mechanical fastening elements or hooks of a male mechanical fastener. These male mechanical fasteners comprise a base material having hooks or male mechanical fastening elements comprising upstanding stems with individual hook fiber engaging elements projecting from a top portion of the stems. These fiber engaging elements are capable of engaging individual or multiple fibers of the loop fastening material.

The precursor to the invention loop fastening material comprises a backing material of an orientable substrate onto which is secured a plurality of multi-filament yarns. The individual yarns are arranged substantially parallel each to the other such that the yarns are intimately bonded to the orientable sheet material along substantially the entire length of the yarns. The individual fibers or filaments of the multi-filament yarns form the loop structures of the loop fastening materials. The precursor backing material and yarn laminate is then oriented at least transverse to the lengthwise direction of the yarns. The backing material after orientation will generally be thinner (generally by about 10 percent or more) in the regions between the attached yarns due to preferential orientation in these regions. The yarns after transverse orientation will have expanded and become loftier. Also, the yarns after orientation are intermittently attached to the backing by individual filaments on one face of the yarn. At least a portion of the filaments or filament segments on the face of the yarn attached to the backing are substantially unattached or detached from the backing substrate due in part to the orientation or tensilization of the backing substrate. Further, the yarns after orientation are characterized by an average width, between the points of most distant filament attachment to the underlined backing material, to average height ratio of at least about 1.2 to 1, preferably at least 2.0 to 1 (the width and height are determined by a central core of fibers, e.g., about 90 percent of the fibers).

The present invention further relates to a method of producing a novel loop fastening material comprising the steps of:

a) providing a plurality of individual multi-filament yarns characterized by having at least 20 filaments and the filaments being transversely separable under moderate force. For example, if the yarn is a twist yarn the twists are relatively loose;

b) providing a orientable backing material;

c) securing the plurality of multi-filament yarns to the backing material so that each of the individual yarns is substantially continuously secured to the backing material, e.g., arranged in a substantially parallel relationship to the adjacent multi-filament yarn(s); and d) transversely (to the length of the yarns) orientating the orientable backing material with the multi-filament yarns attached thereto, by at least 2.0 to 1 providing a loop fastening material capable of engaging a male mechanical fastening element.

The present invention further relates to a hook and loop fastening closure system attached to an article comprising the invention loop fastening material formed into a loop fastener on one closure surface on the article in combination with a hook or male mechanical fastener on a second closure surface on the article. The closure surfaces are generally not rotatable relative to each other such that the hook and/or loop fasteners have a predetermined orientation.

Further, the hooks have overhanging fiber engaging elements. A substantial portion of said overhanging fiber engaging elements are oriented on the second closure surface such that at least a portion of the overhang of the fiber engaging elements is in a direction substantially parallel to the transverse orientation direction of a loop fastener formed of the loop fastening material.

DETAILED DESCRIPTION OF THE PREFERRED EMBODIMENTS

Referring to FIG. 1 there is shown a first embodiment for producing the loop fastening material of the present invention. Initially there is provided a series of yarns 12 supplied on bobbins or packages 11 which are generally located on a creel, beam or like device (not shown). The individual yarns can be conventional twisted yarns or core and effect yarns, such as disclosed in U.S. Pat. Nos. 5,447,590 and 5,379,501 or any similar type yarn capable of being expanded or stretched in the transverse direction by at least 1.2 to 1, preferably at least 2.0 to 1. Preferred are conventional twisted yarns which have a relatively low number of twists per unit length of the yarn. With continuous filament yarns, the number of twists can be as low as feasible and still produce a handleable yarn. Generally, this is as low as 5 twists per meter but the number of twists can range from 5 to 5,000 twists per meter, preferably 10 to 1,000 twists per meter. With yarns formed from fibers having discrete lengths the number of twists must be sufficient to ensure the fibers will not pull loose from the yarn. Generally, this lower limit is about 3 to 4 twists per average fiber length, preferably at least 5 twists per average fiber length. The upper limit on twists per unit length is not specific, however, if the yarns are too tightly twisted they will not be transversely separable under moderate force and not perform as a loop fastening material.

The yarns typically can comprise 20 to 1000 filaments, preferably 50 to 500 filaments. Each filament will generally have a denier of at least 2, preferably 2 to 5. The individual filaments forming the yarn can be formed of any conventional filament forming material such as nylon, polyester, polyolefin, polyamine, rayon, wool, cotton or any other natural or reconstituted cellulosic fiber. Generally, the filaments have a length of at least 2 cm, preferably at least 5 cm. Preferably the filaments are formed of a thermoplastic material such as polypropylene, polyethylene, polyester, polyamides or the like.

The individual yarns 12 can be fed from the creel of individual packages 11 into a comb 13, or like device, which uniformly spaces and distributes the yarns prior to being fed to a series of take-up or feed rolls 14 and 15 (optional). A further comb can be supplied downstream of the rolls 14 and 15 to ensure that the yarns remain properly spaced prior to being joined to the orientable backing substrate 2.

The orientable backing substrate 2 can be provided from a supply roll 3 which then can be coated with a suitable hot-melt or pressure-sensitive adhesive by a nozzle 8, or the like, prior to being joined to the spaced, substantially parallel multi-filament yarns 12. Alternatively, the backing substrate can have an adhesive coating or layer provided previously and supplied as such in roll form as is known in the art. The adhesively coated orientable backing can then be fed by use of rolls 4 and 5 (which preferably are release coated such as by a Teflon™ coating if the adhesive layer or coating is tacky). The roll 5 can be heated if the adhesive is a hot melt adhesive and a further nip roll (not shown) could be provided to form a pressure nip between it and roll 5. This further nip roll could also be heated or cooled as required. The laminate of multi-filament yarns and film backing 21 is then fed to a transverse orientation device 23, which can be any conventional device for transversely orienting films, such as a tentering device, diverging rotating discs or the like. The resulting loop fastening material 25 comprises a transversely oriented film 33 with like-wise transversely oriented multi-filament yarns 16, which fastening material 25 can be collected on a take-up roll 24 or cut into individual loop fastener patches sized for particular end uses.

The orientable backing substrate 2 can be formed of any web material which can be transversely oriented, permanently deformed and adhesive secured to the multi-filament yarns 12. Suitable backings include substantially consolidated nonwoven material, a single or multilayer film of orientable plastic, an extrusion coated nonwoven material, suitable woven fabrics and the like. The backing could be in the form of a pressure-sensitive adhesive tape or a film with a layer of heat softenable hot melt adhesive or thermoplastic material. Preferably, the backing substrate 2 would comprise a single or multilayer thermoplastic film formed of materials such as polyolefins, polyesters or the like. Also, the backing substrate after orientation is generally as thin as possible to provide a relatively low cost and pliable substrate, generally having an average thickness of about 10 $\mu$ to 100 $\mu$, preferably 20 $\mu$ to 50 $\mu$. If the backing substrate average thickness is much below 10 $\mu$ with most suitable materials, the substrate will not have sufficient integrity to allow it to be withdrawn from the supply roll 3 and undergo the processing required without occasional breakage, tearing or the like. If the backing substrate thickness is much above 150 $\mu$ the substrate generally is too rigid and unsuitable for most low-cost loop fastener usages where the invention finds primary applicability, such as disposable garments (e.g., diapers).

Figure 2:
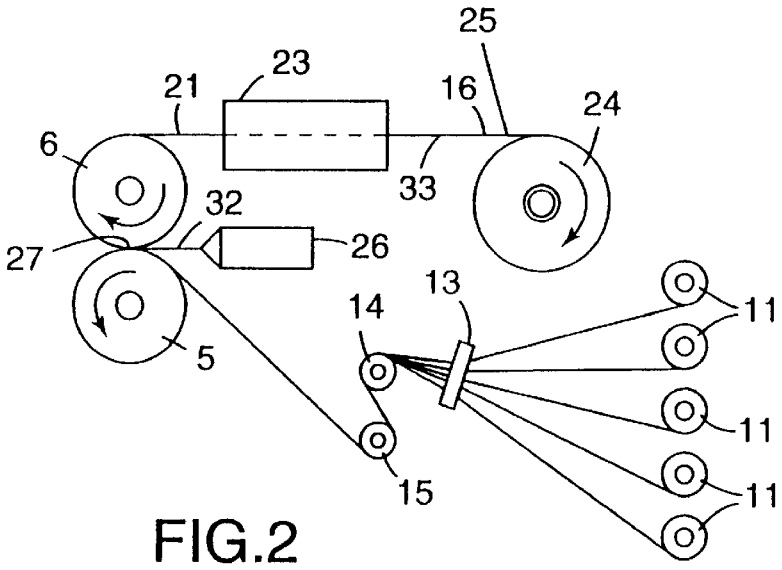
FIG. 2 is a second embodiment of a method for making the invention fabric as shown in FIGS. 4 and 6.
Figure 3:
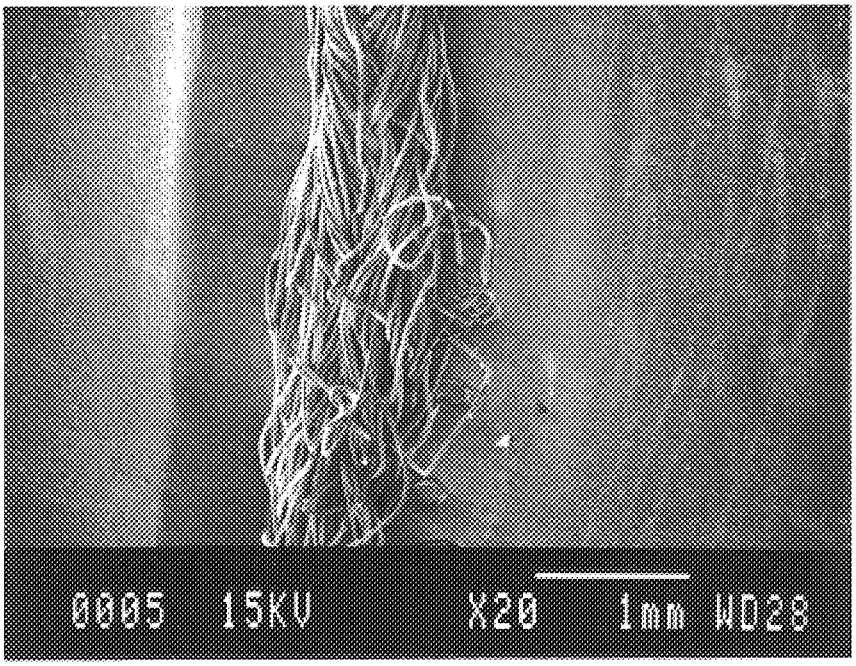
FIG. 3 is a top micrograph view of a yarn 12 as attached to a film 2 before transverse elongation.
Figure 4:
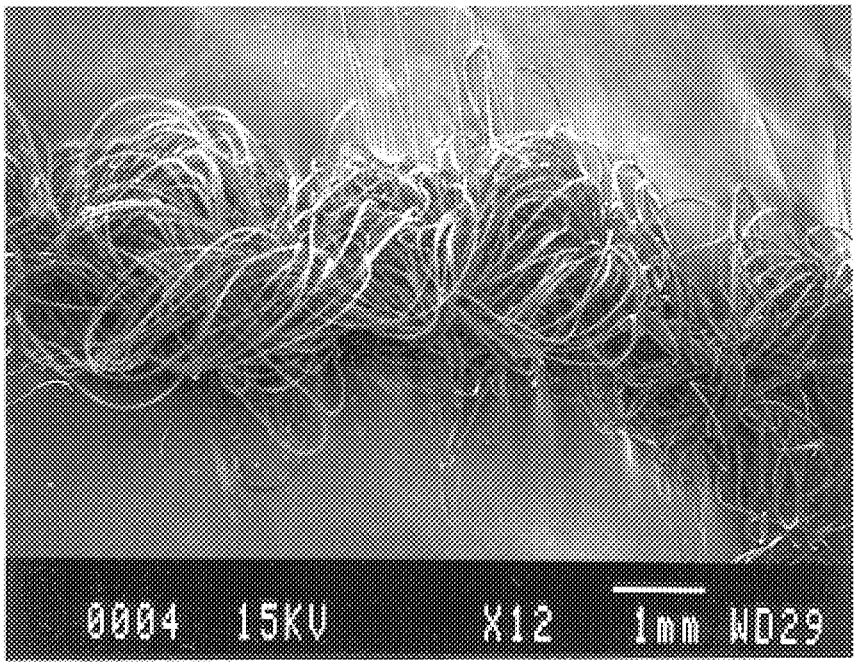
FIG. 4 is a top view of the FIG. 3 yarn following transverse elongation at 3.5:1.
Figure 5:
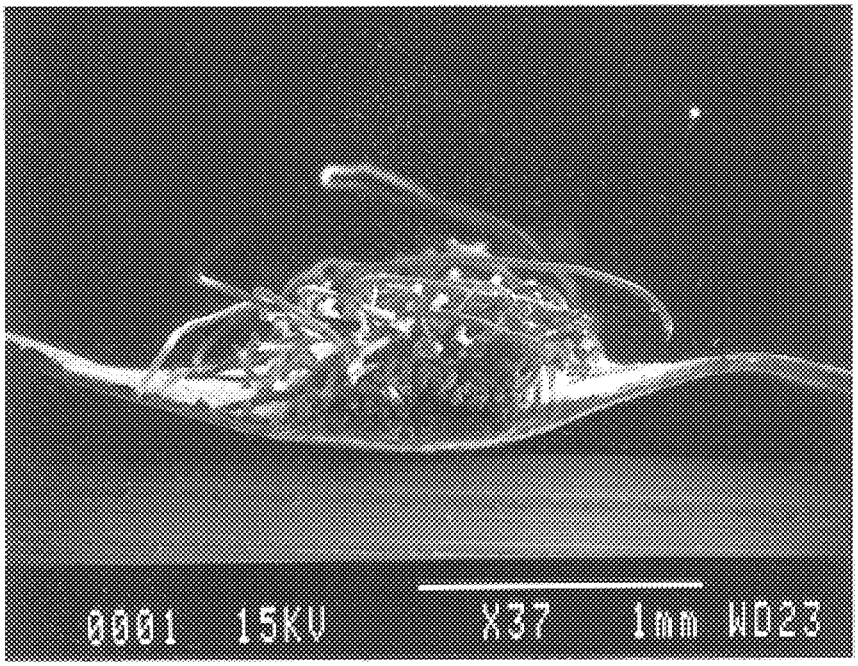
FIG. 5 is a cross-sectional view of the yarn of FIG. 3.
Figure 6:
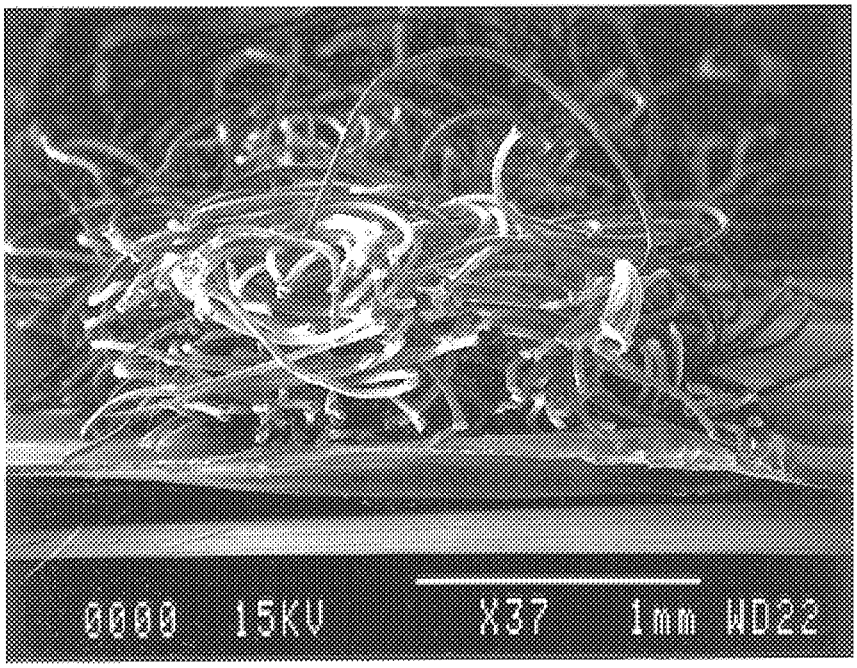
FIG. 6 is a cross-sectional view of the yarn of FIG. 4.

FIG. 2 illustrates a second method of producing the invention loop fastening material. The elements depicted in FIG. 2 substantially correspond to those shown in FIG. 1 except that the individual multi-filament yarns are joined to a backing 32 by directly extruding a film backing 32 onto the spaced yarns with film extruder 26. The backing substrate 32 comprises a thermoplastic film extruded in a molten state from a suitable extrusion die 26 into a nip 27 formed by rolls 5 and 6. The multi-filament yarns are also in the nip 27 and are bonded onto or into the forming thermoplastic film. This bonding can be by mechanical entrapment of fibers in the film material and/or by adhesive bonding between the film and the yarn filaments. The form of bonding depends on the, e.g., material forming the film and/or filaments, extrusion conditions and nip pressure. The extruded thermoplastic backing layer 32 can be cooled when engaged with the rolls forming the nip 27, for example, rolls 5 or 6 could be suitably cooled for this purpose. The film is then collected for further treatment at a subsequent time, or fed directly to a transverse orientation device 23 as described above.

Preferably, the molten thermoplastic material forming the film has a suitable viscosity and the nip pressure is low enough such that the thermoplastic material envelopes and/or engages a plurality of the filaments of the yarn on one face thereof without substantially encapsulating the yarn(s) as a whole. Also preferably, the yarns are formed primarily of filaments having a melting temperature above or close to that of the thermoplastic material forming film backing 32. This is so that when the molten film backing 32 polymer is extruded into the nip 27, all the yarn filaments in contact with the yarn are not substantially melted. However, a suitable portion of the filaments forming the multi-filament yarns can be such that they soften or melt when in contact with the thermoplastic polymer as it exits die 26, such as suitable binder fibers of a sheath/core or like construction. In sheath/core binder fibers, the outer layer of the binder fiber would be formed of a lower melting point material such as a polyethylene vinyl acetate, or low melting point polyester. The core could be formed of a higher melting point polymeric material. Use of appropriate binder fibers in the multifilament yarn could enhance engagement of the yarn to the extruded film backing.

The nip rolls 5 and 6 are preferably cooled, such as liquid cooled rolls, and are preferably smooth surfaced such as provided by chrome plating. However, roll 5 can have a textured or high friction surface so as to help avoid slippage of the multi-filament yarns when in the nip 27. For example, roll 5 could be provided with a high friction surface such as a rubber surface layer.

In the nip 27, the multi-filament yarns 12 are preferably spaced at a distance of 5 mm or less so that the spacing between adjacent yarns after transverse orientation is less than 10 mm, preferably less than 5 mm. Generally the yarns 12 are spaced so that the hook or male mechanical fastener used with a loop fastener, formed or cut from the loop fastener material, will engage at least two transversely spaced yarns. However, if the intended use does not involve significant shear or peel forces (e.g., a seat headliner) a single stand of yarn can be used on the loop fastener. If desired, an additional orientable sheet or web can be incorporated on the face of the thermoplastic film 32 opposite that joined to the multi-filament yarns 12 such as a woven, knitted or other type of fibrous sheet or web or a second film layer. This added web substrate can be used to increase strength or improve the tactile feel or provide other performance or aesthetic qualities. This opposite face of film 32 could also be provided with further multifilament yarns, as above, to provide a two sided loop fastening material.

Preferably, the speeds of the two rollers 4 and 5 are individually controllable so that they can be operated at the same or different surface speeds. Preferably, the speeds of both rollers 5 and 6 are greater than the extrusion rate of the thermoplastic film 32 from die 26 so that the thermoplastic film undergoes a certain amount of elongation and reduction of thickness prior to being joined to the multi-filament yarns.

A further consolidation of the loop fastening materials 25 formed by the methods described above with respect to FIGS. 1 and 2 is also desirable in some cases. In particular, the transversely oriented yarns can be further pattern bonded to the backing by ultrasonic bonding, heat and/or pressure bonding or adhesive bonding by conventional means. The pattern is preferably such that at particular points along each yarn the entire yarn width, transverse to the yarn longitudinal direction, are integrally bonded to the backing. This can be done by bond regions extending at least to some extent in the transverse direction to the yarns and preferably in the form of bond lines. These bond lines can have some longitudinal direction but preferably have less than a 60 degree angle, most preferably less than a 45 degree angle, to the yarn transverse direction. Point bonding or other forms of pattern bonding may not be as preferred but could also be used, such as described in PCT Application No. WO 95/33390 (Allen et al.).

This secondary bonding provides additional points of securement for fibers at more or less regular intervals. The yarn fibers, even though not available to engage hooks at these bond sites, are overall more securely bonded to the backing providing better peel performance for the loop fastening material. Thus if the yarn fibers become too unattached in the transverse orientation step secondary bonding can be used to provide secure regular attachment without significant adverse effect on the loft created by the transverse orientation of the yarns. This pattern bonding can be in the form of, e.g., continuous or intermittent lines, which can be parallel or intersecting and can be straight, wave-shaped or random. If the lines are intermittent the continuous segments are preferably on average at least as long as the average width of the transversly expanded yarns, preferably at least twice the average width of the transverse tensilized yarns. The lines can also be in the form of geometric shapes arranged in regular or random patterns. Although less preferred patterned solid dots or the like are also possible. Preferably each single bond dot will bond a plurality of filaments in a yarn, preferably an entire cross sectional width of a single yarn. The distance between bonded points or regions on a single yarn should generally be less than about 3 cm, preferably less than 2 cm and for discontinuous filaments, preferably less than the average fiber length, and most preferably less than half the average fiber length. The preferred form of bonding is by heat or ultrasonic bonding as is known in the art. The overall bond area of the fibers should be less than 25 percent of the transversely expanded yarn cross sectional area, preferably less than 15 percent to about 1 to 5 percent.

The transverse orientation of the backing substrate, multi-filament yarn laminate 21 is generally at least 2 to 1, preferably at least 3 to 1 up to the natural draw ratio of the backing substrate. During the orientation, a substantial portions of the yarn filaments, adhesively or mechanically engaged with the orientable backing material, become at least partially disengaged. This filament disengagement and transverse separation of the filaments forming the yarns allow individual loop yarn filaments to expand both transversely, in the direction of substrate orientation, and outwardly from the backing substrate. As such, although the original yarn would generally have a substantially circular or uniform cross-section, the ratio of the expanded yarn average width to height after orientation generally becomes at least 1.2 to 1, preferably at least 2.0 to 1. However, generally this ratio is inpercise due to filaments extending out randomly from the central core of the yarn.

Also, as individual filaments disengage with the backing, a substantial portion of the filaments of the multi-filament yarns are free to move away from the backing resulting in increased overall loft and volume of the yarns, allowing greater male mechanical fastening element penetration. Individual filaments also, although generally still oriented primarily in the direction of the length of the filament, take on a certain degree of transverse orientation. The disengagement of the fibers from or filaments the backing during the transverse orientation also assist in the formation of loop structures increasing the availability of filaments for engagement with the male mechanical fastening elements.

The resulting loop fastening material 25 is suitable for forming into loop fasteners for engaging male mechanical fastening elements of conventional design. For example, the loop or filament engaging elements at the top of the male mechanical fastening elements can be of any conventional shape including a mushroom-style hook, a J-hook or a multi-directional hook. Generally when forming a mechanical closure system using the invention loop fasteners the overhanging portions of the fiber or filament engaging elements on the male mechanical fastening elements are fixed on one closure surface so that they are oriented in a direction substantially parallel to the direction of transverse orientation of the oriented backing substrate of the loop fastener. This orientation of the fiber engaging elements of the hooks and the loop fastener provides for maximum peel force for the resulting closure system.

The size and shape of the male mechanical fastening elements employed depends in part on the degree of openness and loft of the loop fastening material following orientation of the backing and the attached yarns. Preferably, the male mechanical fastening element fiber engaging element average overall height is less than the average height of the yarns on the loop fastener material, most preferably at least 1 to 50 percent of the average height of the multi-filament yarn material following orientation.

EXAMPLES 1 THROUGH 3 AND COMPARATIVE EXAMPLES 1 THROUGH 3

Sheets of loop material according to the present invention were made using the method substantially as illustrated in and described with respect to FIG. 2. Three different examples of loop material were prepared using the polypropylene yarns listed in Table I.

TABLE I

| Example | Denier/Filament |
|---|---|
| 1 | 300/144 |
| 2 | 650/144 |
| 3 | 1300/288 |

The yarns are available from Amoco Fabrics and Fibers Company (Bainbridge, Ga.) as 300AT (Type 176), 650AT (Type 171) and 1300AT (Type 171), respectively (Example 2 is shown in FIGS. 3 through 6).

The yarns were placed in alternate spaces between the teeth of a comb having 16 teeth per inch (6.3 per cm) to form a sheet of essentially uniformly distributed yarns with approximately 42 strands of yarn over a 5 inch (12.7 cm) width. The sheet of yarns was then fed between two nip rolls. One of the rolls was a steel casting roll maintained at 100° F. (38° C.); the other roll was a rubber coated roll maintained at 80° F. (27° C.). The pressure between the nipped rolls was 50 psi and the nip rolls provided a line speed of 20 feet per minute (6 meters per minute). As the yarns passed through the nip rolls, polypropylene resin, commercially designated as 7C50 (available from Shell Chemical Company), was extruded through a die at a die temperature of 440° F. (227° C.) and onto the yarns just prior to the nip in an amount appropriate to form a thermoplastic backing layer. The thermoplastic backing layer was approximately 2 mils (50.8 microns) thick and 8 inches (20 cm) wide. Sheet samples of the web were then transversely stretched by hand at a ratio of about 3.5:1 (cross direction:machine direction) to give the loop material of the present invention. The average caliper of the film before and after orientation (by about 3.5 to 1) is shown in Table II. The finished yarn density for each sheet of loop material was approximately 4 yarns per inch width of web.

TABLE II

| | Film Caliper Between Yarns | | Film Caliper Under Yarns | |
|---|---|---|---|---|
| Example | Unstretched | Stretched | Unstretched | Stretched |
| 1 | 2.4 | 1.1 | 2.2 | 1.4 |
| 2 | 2.8 | 1.1 | 2.2 | 1.8 |
| 3 | 2.3 | 1.2 | 2.1 | 1.5 |

Samples of the loop materials were tested for 135 degree peel in accordance with the test method described below. The 135 degree peel test measures the amount of force it takes to remove a strip of hook fastener material that is attached to a piece of loop fastener material while peeling the hook material from the loop material at a 135 degree angle and constant peel rate. The hook fastener material used for testing was a mushroom head type hook available from 3M Company as XPH-4198. For comparison, samples of each loop material prior to transverse stretching were also tested. The 135 degree peel results (in grams per 2.54 cm width) are given in Table III.

TABLE III

| Example | 135 Degree Peel (unstretched) | 135 Degree Peel (stretched) |
|---|---|---|
| 1 | 38 | 117 |
| 2 | 30 | 348 |
| 3 | 68 | 437 |

The test results show a significant improvement in 135 degree peel performance between the stretched and the unstretched materials.

135 Degree Peel Test

A 2 inch×5 inch (5.1 cm×12.7 cm) sample of loop fastener material was securely placed on a 2 inch×5 inch (5.1 cm×12.7 cm) steel panel by using a double coated adhesive tape. A 1 inch×5 inch (2.5 cm×12.7 cm) strip of hook fastener material was cut and marks placed 1 inch (2.5 cm) from the end of each of the hook fastener materials. The strip of hook fastener material was then centrally placed on the loop panel so that there was a 1 inch×1 inch (2.5 cm×2.5 cm) contact area between the hooks and the loops and the leading edge of the strip of hook fastener material was along the length of the panel. The sample was rolled by hand, once in each direction, using a 4.5 pound (100 gram) roller at a rate of approximately 12 inches (30.5 cm) per minute, to engage the hook and loop fastener materials. Paper was used between the hooks and loops to mask the hooks and ensure an engagement area of no more than 1 $inch^2$ (2.54 $cm^2$). Holding the leading edge of the strip of hook material, the sample was sheared (pulled in the plane of the loop material in the direction opposite the peel direction slightly by hand approximately ⅛ inch (0.32 cm) to enhance the engagement of the hooks into the loops.

The sample was then placed into the lower jaw of an INSTRON™ Model 1122 tensile tester. Without pre-peeling the sample, the leading edge was placed in to the upper jaw with the 1 inch mark at the bottom edge of the upper jaw. At a crosshead speed of 12 inches (30.5 cm) per minute, a chart recorder set at a chart speed of 20 inches (50.8 cm) per minute was used to record the peel that was maintained at a 135 degree angle. For each test, the four highest peaks were recorded in grams and were averaged. The force required to remove the hook strip from the loop material was reported in grams per inch-width. Reported values are an average of at least four tests.

EXAMPLE 4

Yarns from Hercules, Inc. (Wilmington, Del.), 500/198 type T734, were placed in spaces of a comb having 16 teeth per inch. The yarns were then bonded to 7C50 PP resin in the same manner as Example 4, 2 mils thick. The sample was then machined stretched 2.8 to 1 between two rotating diverging disks which engage the web. This yielded a finished yarn density of approximately 6 yarns per inch width of web.

The yarns were then additionally bonded by creating a bond line in the transverse direction by placing the web in a SealMaster 420 manufactured by Audion Electro. The heat setting was at 4 and the seal time was approximately 2 seconds. This created a bond line approximately 1/16" wide. The bond lines were spaced by hand between ⅜ and ½ inch.

We claim:

1. A method of producing a loop fastening material for a hook and loop fastening closure system comprising the steps of:

a) providing a plurality of individual multi-filament yarns characterized by having at least 20 filaments and the filaments being separable;

b) providing a orientable backing material;

c) securing the plurality of multi-filament yarns to the backing material so that each of the individual yarns is secured to the backing material in a substantially parallel relationship to the adjacent multi-filament yarns; and d) transversely stretching the orientable backing material and the multi-filament yarns attached thereto by at least 2.0 to 1 providing a loop fastening material capable of engaging a male mechanical fastening element.

2. The method of claim 1 wherein the orientable backing material is a thermoplastic film provided by extrusion lamination to the multifilament yarns.

3. The method of claim 1 wherein the yarns are substantially continuously attached to at least a first face of the backing material forming a sheet material, said yarns extending lengthwise in a first direction with said sheet material being orientated in a direction substantially transverse to said first direction.

4. The method of claim 1 wherein the backing material is a film.

5. The method of claim 1 wherein the backing material is a woven or nonwoven web or laminate.

6. The method of claim 1 wherein the multi-filament yarns are formed of a thermoplastic orientable polymer.

7. The method of claim 1 wherein the backing material is formed of a thermoplastic orientable polymer.

8. The method of claim 1 wherein the multifilament yarns are twisted filament yarns which are spaced on the backing material an average by 10 mm or less following orientation of the backing material.

9. The method of claim 8 wherein the twisted filament yarns have an average of at least 20 filaments which yarns are spaced on average by at least 5 mm or less following orientation of the backing material.

10. The method of claim 8 wherein the yarn has 50 to 500 filaments.

11. The method of claim 9 wherein the filaments have an average denier of at least 12.

12. The method of claim 9 wherein the filaments have an average denier of from 2 to 5.

13. The method of claim 1 wherein the yarn is formed of continuous filaments and has from 5 to 500 twists per meter.

14. The method of claim 1 wherein the backing material is oriented by at least 3.0 to 1.

15. The method of claim 1 wherein the average backing material thickness is about 10 $\mu$ to 100 $\mu$ following orientation.

16. The method of claim 15 wherein the backing material has an average thickness of about 20 $\mu$ to 30 $\mu$ following orientation.

17. The method of claim 1 wherein the orientation causes at least a portion of the yarn filaments or a yarn filament segment, on a face of the yarn attached to the backing material, to substantially detach from the backing material.

18. The method of claim 17 wherein the average width to height ratio of the yarns is at least 1.2 to 1 following orientation of the backing material.

19. The method of claim 18 wherein the average width to height ratio of the yarns is at least 2 to 1 following orientation.

20. The method of claim 1 wherein the filaments forming the yarn have discrete lengths and the yarns have at least 3 twists per average filament length.

21. The method of claim 20 wherein the filaments are at least 2 cm long.

22. The method of claim 20 wherein the filaments are at least 5 cm long.

23. The method of claim 1 wherein the filaments forming the yarn have discrete lengths and the yarns have at least 5 twists per average filament length.

24. The method of claim 1 wherein the yarns have from 10 to 100 twists per meter.

25. The method of claim 1 further comprising pattern bonding the yarns to the backing material at intermittent points along their lengths.

26. The method of claim 25 wherein the pattern bonds extend across substantially the entire width of the yarns at the individual pattern bond points.

27. The method of claim 25 wherein the distance between bond points is less than 3 cm.

* * * * *